US009296556B2

(12) United States Patent
Townsend et al.

(10) Patent No.: US 9,296,556 B2
(45) Date of Patent: Mar. 29, 2016

(54) FLEXIBLE FABRIC SHIPPING AND DISPENSING CONTAINER

(75) Inventors: Phillip Lynn Townsend, Spring, TX (US); Gary Dale Krch, Friendwood, TX (US)

(73) Assignee: Utilequip, Inc., Houston, TX (US)

( * ) Notice: Subject to any disclaimer, the term of this patent is extended or adjusted under 35 U.S.C. 154(b) by 794 days.

(21) Appl. No.: 12/477,211

(22) Filed: Jun. 3, 2009

(65) Prior Publication Data

US 2009/0304308 A1 Dec. 10, 2009

Related U.S. Application Data

(60) Provisional application No. 61/059,553, filed on Jun. 6, 2008.

(51) Int. Cl.

| | |
|---|---|
| ***B65D 88/22*** | (2006.01) |
| ***B65D 88/16*** | (2006.01) |
| ***B65D 90/00*** | (2006.01) |
| *B65D 90/10* | (2006.01) |

(52) U.S. Cl.

CPC ..... *B65D 88/22* (2013.01); *B65D 88/1662* (2013.01); *B65D 90/0033* (2013.01); *B65D 90/10* (2013.01)

(58) Field of Classification Search

CPC .... B65D 33/02; B65D 33/12; B65D 88/1618; B65D 88/1631; B65D 88/1625; B65D 2588/165; B65D 88/22; B65D 88/1662; B65D 90/0033; B65D 90/10

USPC ..... 383/7, 15, 17, 18, 36, 41, 67, 80, 100, 383/117, 904, 906

See application file for complete search history.

(56) References Cited

U.S. PATENT DOCUMENTS

| | | | | |
|---|---|---|---|---|
| 2,615,488 | A * | 10/1952 | Brady et al. | 383/76 |
| 2,724,418 | A * | 11/1955 | Krupp | 220/565 |
| 3,105,617 | A * | 10/1963 | Felldin | 222/181.3 |
| 3,509,848 | A * | 5/1970 | Salmon | 114/245 |
| 3,888,288 | A * | 6/1975 | Hickle et al. | 99/646 S |
| 3,919,030 | A * | 11/1975 | Jones | 156/211 |
| 3,965,953 | A | 6/1976 | Becker et al. | |

(Continued)

FOREIGN PATENT DOCUMENTS

| | | |
|---|---|---|
| EP | 0937658 A2 | 8/1999 |
| FR | 2424200 A1 | 11/1979 |

(Continued)

OTHER PUBLICATIONS

PCT/US2009/046057 International Search Report and Written Opinion, Jan. 18, 2010.

(Continued)

*Primary Examiner* — J. Gregory Pickett
*Assistant Examiner* — Peter Helvey
(74) *Attorney, Agent, or Firm* — Chamberlain Hrdlicka

(57) ABSTRACT

An apparatus for shipping a flowable material in a cargo compartment of a transport includes an enclosure forming a chamber therein to house the flowable material. The enclosure is made of braided or woven fabric. The inner surface of the fabric is coated whereby the fabric is impermeable to the flowable material. The enclosure has at least one closable opening serving as an inlet or outlet to the chamber, and is pliable such that it can be housed within the cargo compartment in any orientation.

32 Claims, 5 Drawing Sheets

(56) References Cited

U.S. PATENT DOCUMENTS

| | | | | | |
|---|---|---|---|---|---|
| 3,978,901 | A * | 9/1976 | Jones | 206/524.5 |
| 4,211,266 | A * | 7/1980 | Massey | 383/6 |
| 4,431,316 | A * | 2/1984 | Massey | 383/113 |
| 4,480,766 | A * | 11/1984 | Platt | 222/105 |
| 4,640,328 | A * | 2/1987 | Arney | 220/9.1 |
| 4,872,493 | A * | 10/1989 | Everman | 141/59 |
| 4,942,978 | A * | 7/1990 | Bessette | 220/62.21 |
| 4,953,987 | A * | 9/1990 | Schnaars | 383/67 |
| 4,966,310 | A * | 10/1990 | Hawkins | 222/105 |
| 5,031,792 | A * | 7/1991 | Russo, Sr. | 206/386 |
| 5,073,035 | A * | 12/1991 | Williams | 383/19 |
| 5,224,635 | A * | 7/1993 | Wise | 222/608 |
| 5,328,267 | A * | 7/1994 | Cuddy et al. | 383/17 |
| 5,340,217 | A * | 8/1994 | Rothman | 383/17 |
| 5,340,218 | A * | 8/1994 | Cuthbertson | 383/67 |
| 5,348,063 | A * | 9/1994 | Handleman | 141/314 |
| 5,358,335 | A * | 10/1994 | LaFleur | 383/107 |
| 5,368,395 | A * | 11/1994 | Crimmins | 383/107 |
| 5,484,207 | A * | 1/1996 | Schnaars et al. | 383/67 |
| 5,524,781 | A * | 6/1996 | Podd et al. | 220/1.5 |
| 5,746,317 | A * | 5/1998 | Turner et al. | 206/423 |
| 5,865,541 | A * | 2/1999 | Lafleur | 383/120 |
| 6,155,772 | A * | 12/2000 | Beale | 414/607 |
| 6,467,955 | B1 * | 10/2002 | Kim | 383/20 |
| 6,505,657 | B1 * | 1/2003 | Lawrence | 141/114 |
| 7,213,970 | B1 * | 5/2007 | Reicin et al. | 383/107 |
| 7,299,513 | B1 * | 11/2007 | Barrett et al. | 5/654 |
| 2001/0000464 | A1 * | 4/2001 | Beale | 414/607 |
| 2002/0030055 | A1 * | 3/2002 | Maturana | 220/495.06 |
| 2002/0195127 | A1 | 12/2002 | Morioka | |
| 2003/0235349 | A1 * | 12/2003 | Ricahrdson et al. | 383/16 |
| 2003/0235350 | A1 * | 12/2003 | Richardson et al. | 383/24 |
| 2006/0076251 | A1 * | 4/2006 | Hurst | 206/219 |
| 2006/0104546 | A1 * | 5/2006 | Combes | 383/38 |
| 2007/0127852 | A1 * | 6/2007 | Town et al. | 383/16 |
| 2010/0012550 | A1 * | 1/2010 | Dedmon et al. | 206/600 |
| 2010/0192998 | A1 * | 8/2010 | Villers et al. | 135/96 |
| 2014/0301669 | A1 * | 10/2014 | Baeck | 383/3 |

FOREIGN PATENT DOCUMENTS

| | | | |
|---|---|---|---|
| FR | 2521534 | A1 | 8/1983 |
| GB | 915999 | A | 1/1963 |
| WO | 02 083494 | A1 | 10/2002 |

OTHER PUBLICATIONS

European Search Report for EP Application No. 09759297.6, dated Feb. 29, 2012.

* cited by examiner

FLEXIBLE FABRIC SHIPPING AND DISPENSING CONTAINER

CROSS-REFERENCE TO RELATED APPLICATIONS

This application claims benefit of U.S. Provisional Application Ser. No. 61/059,553 filed on Jun. 6, 2008, and entitled "Flexible Fabric Shipping and Dispensing Container," which is hereby incorporated herein by reference in its entirety for all purposes.

STATEMENT REGARDING FEDERALLY SPONSORED RESEARCH OR DEVELOPMENT

Not applicable.

BACKGROUND OF THE INVENTION

The present invention relates generally to shipping containers and, more particularly, to fabric shipping and dispensing containers.

Containerization is the method of shipping a large amount of cargo material packaged into large standardized metal shipping containers. The containers are sealed and loaded onto ships, railroad cars, planes or trucks for transport. To avoid inefficiencies caused by the use of incompatible container sizes, standard container sizes have evolved over time through compromises among railroads and shipping and trucking companies, both domestic and foreign. At this time, the most commonly used shipping containers conform to the standards of the International Organization for Standardization (ISO). As such, these containers have one of five standard lengths. For example, United States domestic standard containers are generally 48 ft or 53 ft in length for shipping via railroad or truck, respectively. However, the 40 ft container is the most popular container worldwide.

Despite the improved efficiencies provided by standardization, ISO containers are not without their shortcomings. ISO containers are rigid, and thus cannot conform to fit within spaces having varied sizes or shapes. Even when empty, these containers have considerable weight. For example, an empty, general purpose 40 ft ISO container weighs approximately 8,380 lbs. Given the rising cost of fuel and their size, transporting an empty ISO container can have a significant cost. ISO containers are frequently damaging during handling, and may rust or corrode when exposed to water or other materials. ISO containers are generally purpose specific, meaning each is designed for storage of the particular type of cargo material to be shipped. For instance, general purpose ISO containers are designed to store dry goods, such as boxes, cartons, etc. Also, when shipping plastic pellets or powders, a disposable liner must be inserted within the ISO container to contain the product and changed when a new product is introduced to the ISO container. When necessary to store and transport a liquid, another type of ISO container, such as a tank container, must be used instead. Due to their rigid structure, ISO containers occupy the same space on the transport whether they are empty, partially full or full. For example, if the cargo material is a flowable material such as a liquid or particulate material, the ISO containers cannot conform to the volume of cargo material in the container. Further, such containers are not collapsible to a smaller footprint when empty. Thus, when these empty containers are transported, they still occupy the same space that could otherwise be used for other purposes.

Also, ISO containers are designed to be nontransparent to the casual viewer so as to reduce the likelihood of tampering or theft. However, their nontransparent nature makes these containers suitable for smuggling contraband. Given that a great number of these containers are not opened and inspected upon arrival in the United States, nontransparent containers raise concerns that these containers may be used to transport unauthorized materials.

Thus, there is a need for a flexible shipping container that may store flowable materials, whether solid or liquid, during transport, dispense the materials upon reaching its intended destination, and collapse when empty. It would be particularly advantageous if the shipping container was transparent to X-ray and ultrasonic inspections and had minimal weight to reduce associated transportation costs.

SUMMARY OF THE PREFERRED EMBODIMENTS

An apparatus for shipping a flowable material in a cargo compartment of a transport is disclosed. The apparatus includes an enclosure forming a chamber therein to house the flowable material. The enclosure is made of braided or woven fabric. The inner surface of the fabric is coated whereby the fabric is impermeable to the flowable material. The enclosure has at least one closable opening serving as an inlet or outlet to the chamber, and is pliable such that it can be housed within the cargo compartment in any orientation.

Some system embodiments include the container and a webbing surrounding the container. The webbing includes a plurality of horizontal straps disposed circumferentially about the container, a plurality of vertical straps extending substantially perpendicularly to and overlapping the horizontal straps, a plurality of attachment locations where one of the horizontal straps overlaps one of the vertical straps, and at least one grappling device coupled to one of the plurality of attachment locations.

Some containerization methods include filling a portion of the container with a flowable material at a first location, stowing the container for transport to a second location, transporting the container to the second location, and dispensing a portion of the flowable material from the container at the second location.

Thus, the enclosure comprises a combination of features and advantages that enable it to provide a high-strength, yet lightweight shipping and dispensing container. These and various other characteristics and advantages of the preferred embodiments will be readily apparent to those skilled in the art upon reading the following detailed description and by referring to the accompanying drawings.

BRIEF DESCRIPTION OF THE DRAWINGS

For a more detailed understanding of the preferred embodiments, reference is made to the accompanying Figures, wherein.

NOTATION AND NOMENCLATURE

Figure 1:
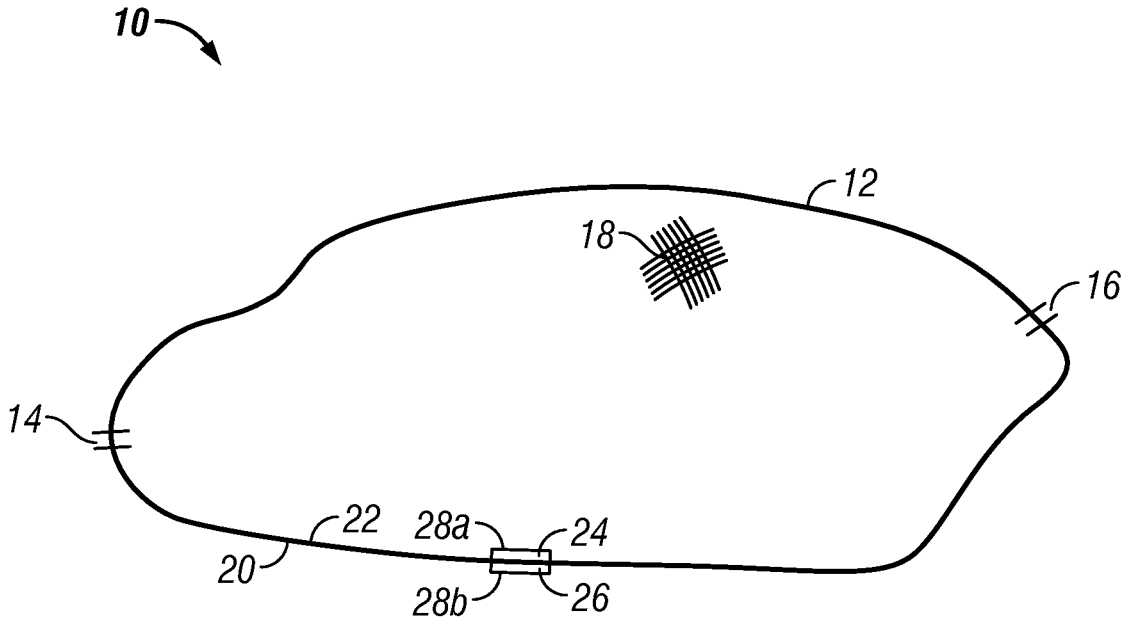
FIG. 1 is a perspective view, partly in cross-section, illustrating a flexible fabric shipping and dispensing container in accordance with the principles disclosed herein.

Certain terms are used throughout the following description and claims to refer to particular system components. This document does not intend to distinguish between components that differ in name but not function. Moreover, the drawing figures are not necessarily to scale. Certain features of the invention may be shown exaggerated in scale or in somewhat schematic form, and some details of conventional elements may not be shown in the interest of clarity and conciseness.

In the following discussion and in the claims, the term "comprises" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections.

DETAILED DESCRIPTION OF THE PREFERRED EMBODIMENTS

Referring initially to FIG. 1, an amorphous shipping and dispensing container (hereinafter "container") 10 forming an enclosure 12 is shown. Enclosure 12 may be of any shape such as oblong, round, or with an irregular shape and provides a chamber for storing a flowable material. In some embodiments, the container 10 has a closeable inlet 14 and a closeable outlet 16, while in other embodiments, a single closeable opening or port may function as both the inlet and outlet. Enclosure 12 is preferably made of a braided fabric 18. Alternatively, fabric 18 of enclosure 12 may be woven, knitted or constructed by other fabric-forming methods known in industry. The size of enclosure 12 is selected at least in part as a function of the space available for transporting container 10 from its filling site to its intended dispensing site. For instance, if container 10 is to be transported by truck, then its overall size is tailored for storage within the truck. On the other hand, if container 10 is to be transported by water, then its overall size is tailored for storage in a cargo hold of a ship or barge.

Fabric 18 of enclosure 12 is high-strength, while at the same time, lightweight. Thus, enclosure 12 has the structural capacity to contain high-density, flowable materials, such as grains and pellets, as well as high-pressure fluids, both liquids and gases. The thickness and other properties of fabric 18 may be tailored as a function of the weight of the nature and density flowable materials to be stored within container 10. Enclosure 12 has minimal weight, which reduces transportation costs for moving container 10 between filling and dispensing locations, as compared to similar costs associated with conventional ISO containers. For example, a container 10 having storage capacity comparable to a general purpose 40 ft ISO container weighs only approximately 1,000 lbs, whereas the 40 ft ISO container weighs significantly more at approximately 8,350 lbs.

Moreover, in some embodiments, container 10 may be configured to allow floatation of container 10 with flowable materials stored therein. Such embodiments may be transported by towing along a waterway. Further, because of the relatively shallow draft of container 10, even when full, container 10 is capable of delivery via waterways that are not navigable by barge.

Fabric 18 of enclosure 12 is tear-resistant. As such, container 10 need not have a top or bottom and may be stowed in virtually any orientation, including on its side, without risk of damage to enclosure 12 or loss or contamination of any materials contained therein. Fabric 18 of enclosure 12 is flexible or pliable and may allow container 10 to conform to storage spaces having varying sizes or shapes. Moreover, when container 10 is empty, the flexibility of enclosure 12 permits container 10 to collapse to occupy only a fraction of the storage space required when container 10 is filled or partially filled.

Fabric 18 of enclosure 12 is also transparent to X-ray and ultrasonic inspections. Thus, materials that may be stored within enclosure 12 can be repeatedly inspected without the need to open container 10 and visually inspect its contents, unlike conventional ISO containers, which are made almost entirely out of steel. In some embodiments, fabric 18 of enclosure 12 includes conductive threads and electrodes in contact with the flowable materials stored therein, thus allowing container 10 to dissipate static electricity. The air-tight nature of container 10 also allows blanketing of the flowable materials with non-explosive gases, such as nitrogen, argon or carbon dioxide. The combination of electrostatic dissipation and the inert atmosphere promotes safety in shipping of materials such as grains, powders for plastics, and certain pyrophoric materials.

The outer and inner surfaces 20, 22, respectively, of enclosure 12 are coated. Inner surface 22 of enclosure 12 is coated with a material 24 to form a coating 28*a*. Coating 28*a* enables container 10 to be impermeable to materials stored therein and to prevent contamination of those materials from sources external to container 10. Additionally, coating 28*a* enables enclosure 12 to contain fluid, either gas or liquid, including pressurized gases or inert gases. Further, material 24 of coating 28*a* may be selected such that it adheres well to the fibers of fabric 18 and is compatible with the expected range of materials to be stored within container 10. Outer surface 20 of enclosure 12 is coated with a material 26 to form a coating 28*b*. Coating 28*b* prevents damage to container 10 from ultraviolet light radiation, ozone in the atmosphere, weather in general, and abrasion during handling of container 10.

Materials 24, 26 of coatings 28*a*, 28*b* over inner and outer surfaces 22, 20, respectively, of enclosure 12 preferably include polyurethane. Polyurethane acts as a moisture barrier and is also abrasion resistant. In other embodiments, material 24 of coating 28*a* over inner surface 22 may be different than material 26 of coating 28*b* over outer surface 20. Moreover, other materials having functionally equivalent properties to polyurethane may alternatively be used.

Fabric 18 of enclosure 12 preferably includes VECTRAN manufactured by KURARAY, which is a manufactured fiber spun from a liquid crystal polymer. VECTRAN is noted for its high strength, thermal stability at high temperatures, abrasion resistance, low density, and chemical stability. Further, VECTRAN is resistant to moisture and ultraviolet radiation. While fabric 18 of enclosure 12 preferably includes VECTRAN, other materials having functionally equivalent properties may be used instead.

Figure 2:
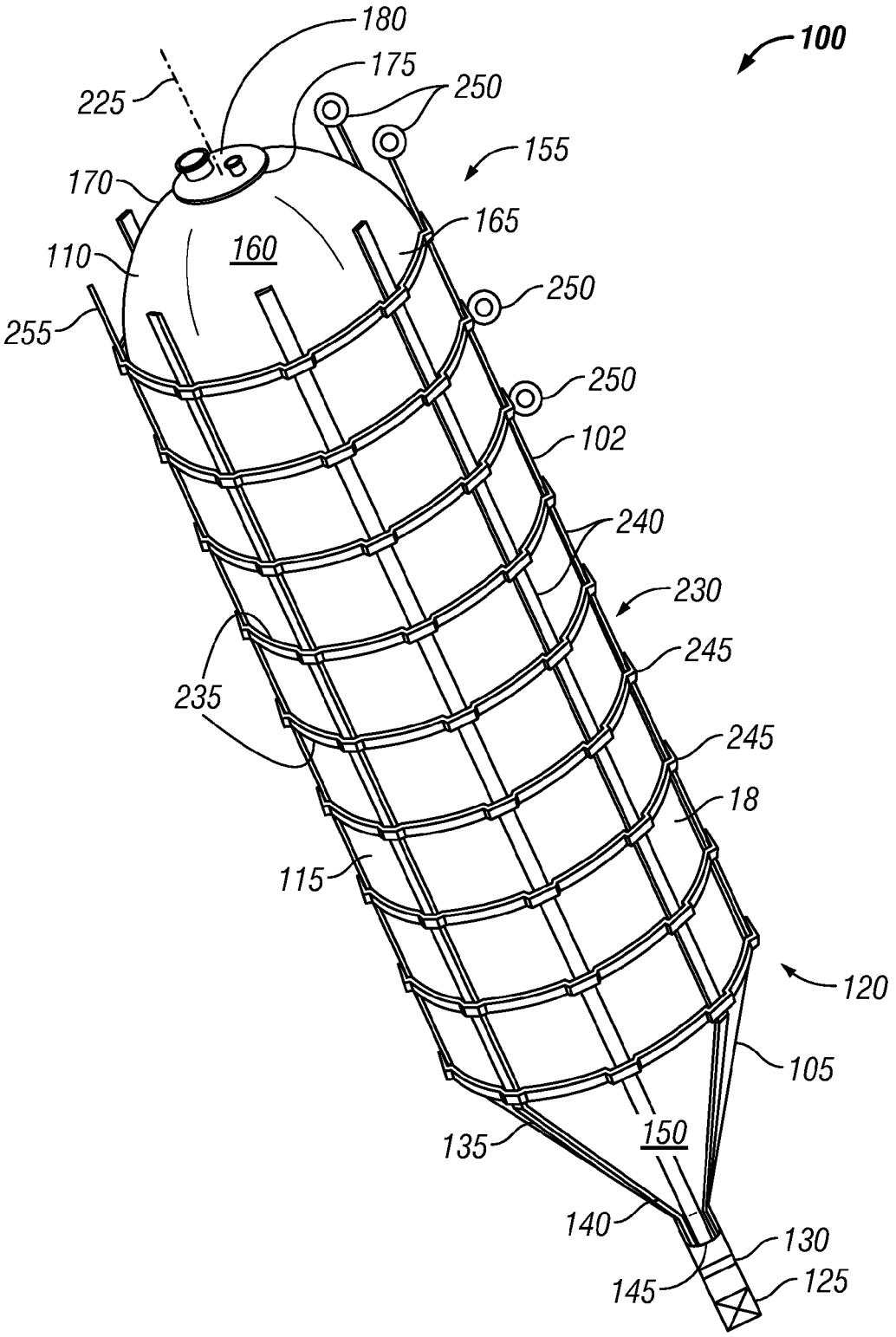
FIG. 2 is a perspective view of another embodiment of a flexible fabric shipping and dispensing container.

Referring now to FIG. 2, there is shown another embodiment of a flexible fabric shipping and dispensing container 100 forming an enclosure 102 with a dispensing cone 105, a filling cap 110, and a body 115 extending therebetween. In some embodiments, body 115 has a generally cylindrical, yet seamless shape. The diameter of body 115 may be as large as 12 feet. In one preferred embodiment, body 115 is 40 feet in length and has a diameter of 10 feet. In another preferred embodiment for transport via truck, body 115 is 38 feet in length and has a diameter of 8 feet. It should be appreciated that enclosure 102 may be of any shape such as oblong, round, or with an irregular shape. Further, enclosure 102 of container 100 may be made of fabric 18 and have coatings 28*a*, 28*b* including materials 24, 26 on its inner and outer surfaces 22, 20, respectively, as previously described.

Dispensing cone 105 is positioned at one end 120 of container 100, and like body 105, is also seamless. Cone 105 includes an end 135 having an outer diameter approximately equal to that of body 105, another end 140 having an outlet, such as dispensing port 145, and a conical flowbore 150 extending therebetween. Cone 105 preferably includes the same braided fabric 18 of body 115. However, cone 105 may alternatively include other equivalent fabrics. Cone 105 is also coated over its inner and outer surfaces, as described above in regards to container 10. Cone 105 may be formed as a component separate from body 115 or integral with body 115. If cone 105 is formed separately from body 115, the components are coupled by stitching the upper end 135 of cone 105 to body 115 using a high strength thread made from VECTRAN or another equivalent material. An adhesive is applied at this interface to strengthen the coupling at this interface and to prevent outward leakage of materials contained within container 100 and inward intrusion of air and moisture. To form cone 105 integral with body 115, the braiding or weaving process of creating seamless body 115 is simply extended to form cone 105, including dispensing port 145.

An inlet, such as filling cap 110, is positioned at another end 155 of container 100. Cap 110 includes a dome or hemispherical body 160 having a first end 165 with an outer diameter approximately equal to that of body 105 and a second end 170 with a passage 175 formed therethrough. Like dispensing cone 105, hemispherical body 160 of filling cap 110 preferably includes the same braided fabric 18 as body 115. However, filling cap 110 may alternatively include other equivalent fabrics. Hemispherical body 160 is also coated over its inner and outer surfaces, again similar to body 115. Hemispherical body 160 may be formed as a component separate from body 115 or integral with body 115. If formed separately from body 115, the two components are coupled by stitching end 165 of hemispherical body 160 to body 115 using a high strength thread made from VECTRAN or another equivalent material. An adhesive is applied at this interface to prevent outward leakage of materials contained within container 100 and inward intrusion of air and moisture. To form hemispherical body 160 integral with body 115, the braiding or weaving process of creating seamless body 115 is simply extended to form hemispherical body 160, including passage 175.

Figure 3A:
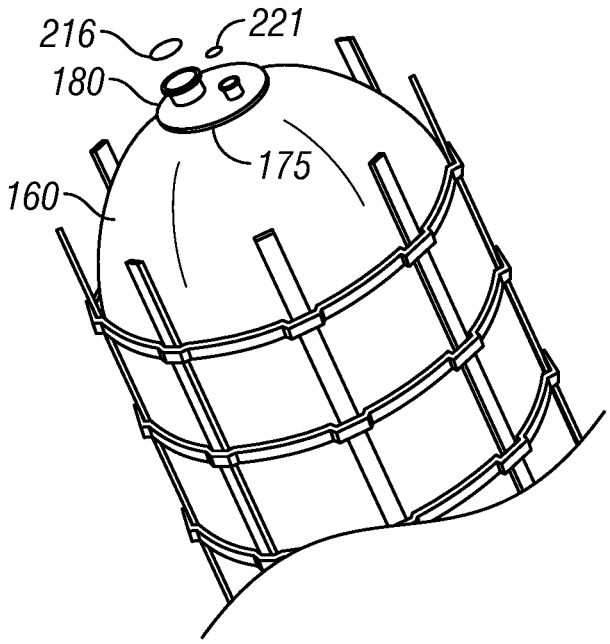
FIGS. 3A and 3B are perspective and cross-sectional views, respectively, of the manway of FIG. 2 and its subcomponents.

Passage 175 of hemispherical body 160 is configured to receive a manway 180, as shown in FIG. 3A. Manway 180 is coupled to hemispherical body 160 such that manway 180 is concentric about passage 175 and extends from the exterior into the interior of container 100, as best shown by the cross-sectional view of container 100 proximate manway 180 depicted in FIG. 3B. Manway 180 includes a cap 185, a flange 190 and a flange adaptor 195 disposed therebetween. Referring to FIGS. 4A through 4C, each of cap 185, flange 190 and flange adaptor 195 includes a matching bolt pattern 200, 205, 210, respectively. Cap 185 of manway 180 further includes a filling port 215 and a vent port 220. Cap 185, flange 190, flange adaptor 195, and covers 216, 221 for filling port 215 and vent ports 220, respectively, include a rigid material. In some embodiments, these components are metallic and include stainless steel.

Figure 3B:
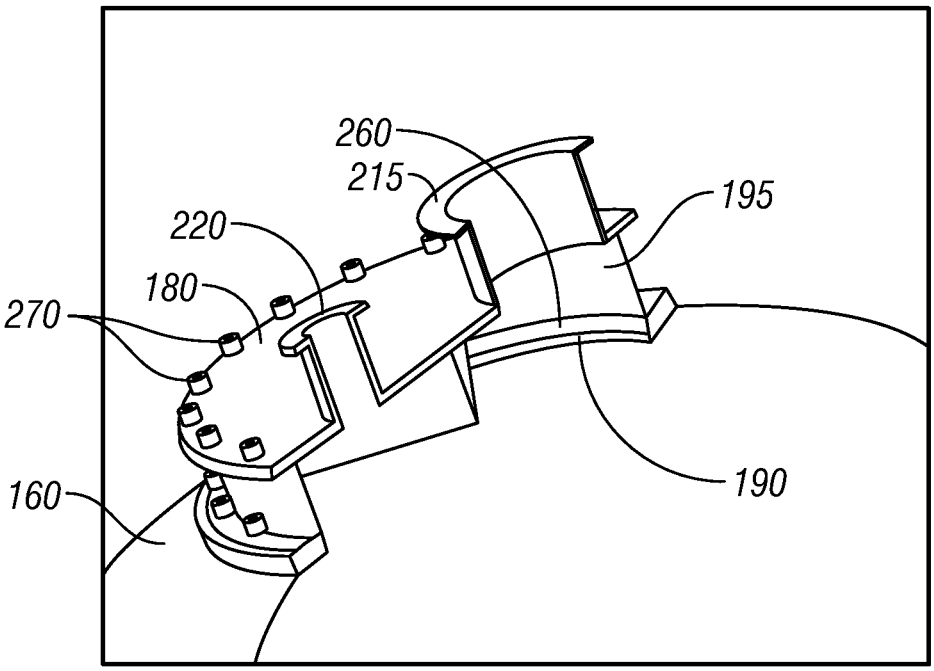
Figure 4A:
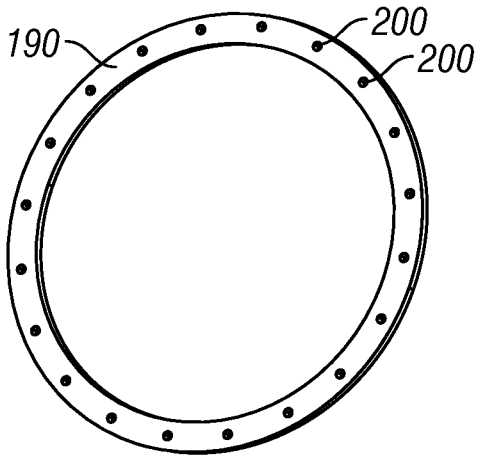
FIGS. 4A through 4C are perspective views of the subcomponents of the manway of FIG. 2.
Figure 4B:
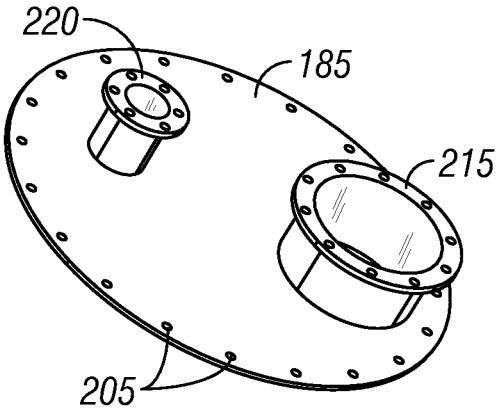
Figure 4C:
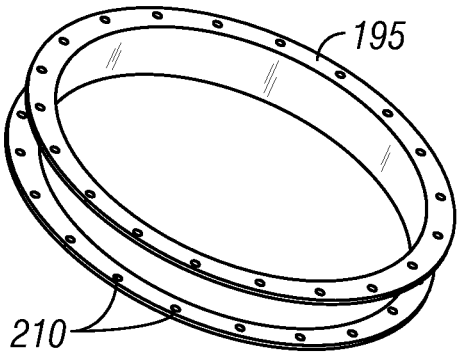

To install manway 180 over passage 175 through hemispherical body 160 of filling cap 110, flange 190 is positioned adjacent the inner surface of hemispherical body 160 of filling cap 110 such that flange 190 is concentric about passage 175, as best shown in FIG. 3B. Flange adaptor 195 is positioned adjacent the outer surface of hemispherical body 160 and concentric to passage 175. Thus, a portion 260 of hemispherical body 160 bounding passage 175 is positioned between flange 190 and flange adaptor 195. Cap 185 is positioned over flange adaptor 195. Flange 190, flange adaptor 195 and cap 185 are coupled by aligning their respective bolt patterns 200, 205, 210 and inserting bolts 270 therethrough.

Container 100 may be filled by introducing flowable materials through port 215. Air, or other gas, displaced by the flowable materials introduced to container 100 is allowed to vent through port 220. In some embodiments, a filter (not shown) may be coupled to vent port 220 to capture particulates entrapped in the displaced air or gas. A cover 216 is bolted to filling port 215 to prevent flow therethrough. This cover 216 may be removed as needed to allow flowable materials to be introduced to container 100 through filling port 215. Similarly, a cover 221 is bolted to vent port 220 to prevent flow therethrough, and may be removed as needed to vent displaced air or other gas during filling of container 100.

Referring again to FIG. 2, when material is introduced into container 100 through filling port 215 or dispensed from container 100 through dispensing port 145, container 100 is suspended in a vertical orientation, such that a longitudinal axis 225 extending lengthwise through container 100 is substantially normal to the ground. To enable suspension of container 100 in this fashion and movement of container 100 during transport, container 100 is disposed within a webbing 230. Webbing 230 includes a plurality of horizontal straps 235 extending circumferentially about container 100 and a plurality of logitudinal straps 240 extending normal to horizontal straps 235. At locations 245 where horizontal straps 235 overlap vertical straps 240, the straps 235, 240 are stitched together using a high strength thread. Each location 245 provides an attachment point for a single D-ring 250, whether by stitching or some other equivalent coupling means. Additional attachment points for D-rings 250 are provided at the upper end 255 of each vertical strap 240.

Container 100 is suspended for filling and dispensing and moved during transport by grappling D-rings 250, rather than by grappling any part of container 100. Webbing 230 eliminates the need for direct attachment of D-rings 250 to container 100, such as by stitching D-rings 250 directly to body 115, which may over time create a rip or tear in body 115 at the points of attachment. Moreover, webbing 230 simply supports container 100 as container 100 is suspended or moved, but is not in any way coupled directly to container 100, such as by stitching. Thus, webbing 230 bears the brunt of cyclic stresses resulting from repeated suspension and movement of container 100, while container 100 does not. Also, by coupling D-rings 250 to locations 245 and ends 255 of webbing 170, rather than to container 100 itself, D-rings 250 may be moved as desired without the need to modify the design of container 100.

Webbing 230, including the stitching which couples horizontal and vertical straps 235, 240, preferably includes nylon. However, webbing 230 may include other equivalent materials. Also, horizontal straps 235 and vertical straps 240 are depicted as equally spaced. These straps 235, 240, however, may be positioned with whatever spacing—uniform or otherwise—is required to create locations 245 for attachment of D-rings 250 that enable convenient and efficient suspension and movement of container 100.

Figure 5:
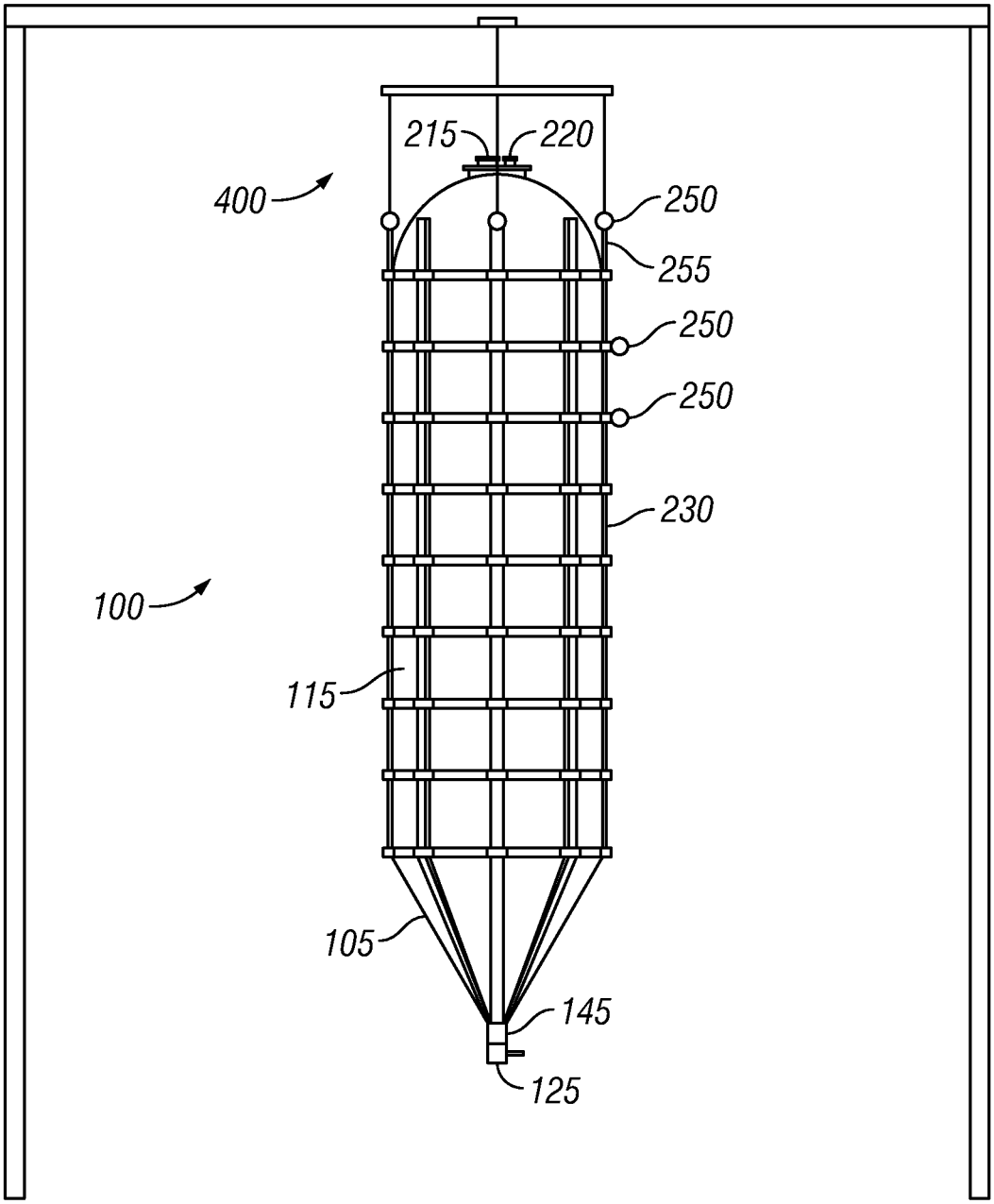
FIG. 5 is a front view of the container of FIG. 2 suspended by a support system.

In operation, container 100 is initially suspended via D-rings 250 coupled to ends 255 of vertical straps 180 of webbing 230 from a support system 400 such that its full length is allowed to unfold and freely hang, as shown in FIG. 5. Filling port 215 and vent port 220 of cap 185 of manway 180 are opened by removing their respective covers 216, 221, while valve 125, coupled to dispensing port 145 of dispensing cone 105, remains closed. Flowable materials are introduced to container 100 through filling port 215. As materials fill container 100, air or other gas displaced by the added materials is vented out of container 100 through port 220. Container 100 is filled to a desired level, but preferably to no more than 75 to 80% of its capacity. By allowing some free volume within container 100, or more specifically body 115, container 100 is free to deform as needed to fit shipping confines having varied sizes and shapes. After container 100 is filled to the desired level, filling port 215 and vent port 220 are again closed by reattaching their respective covers 216, 221 and may be sealed for product security.

Container 100 is then moved from its filling site to a storage location within a cargo hold of a ship or airplane, railroad car, truck bed, or other mode of transportation, by grappling D-rings 250 and supporting container 100 using webbing 230. Upon arrival at its intended storage location for transport, container 100 is stowed in virtually any orientation needed to make efficient use of the allotted storage space. Due to the flexible nature of body 115, as well as the other components of container 100, container 100 deforms, such as by bending or twisting, as needed to fit within the storage space. Further, the moisture and abrasion resistant properties of container 100 enable container 100 to be safely stored on a wide range of surfaces. Due to the high fabric strength of container 100, multiple such containers 100 may be stacked one on top of another as needed to make efficient use of the allotted storage space without risk of damaging containers 100 or loss of or damage to materials stored therein. Because container 100 deforms as needed to fit within its assigned storage location and the materials stored therein subsequently shift to assume the deformed shape of container 100, container 100 remains stable throughout transit regardless of its orientation when stowed. Should additional support be desired during shipping, D-rings 250 and webbing 230 facilitate roping, chaining, or taping to further secure container 100 in its stowed location during transport.

Upon arriving at a dispensing site, container 100 is moved from its stowed location to its intended dispensing site. As before, container 100 is moved and suspended by grappling D-rings 250 and allowing webbing 230 to support container 100. Once suspended, as shown in FIG. 5, filling port 215 is opened, as previously described, to provide a back pressure and valve 125 is selectably opened to controllably dispense materials stored within container 100 though outlet port 145 of dispensing cone 105.

When the desired amount of materials has been dispensed from container 100, valve 125 and filling port 215 are again closed and may be resealed. In the event that all materials stored in container 100 have been dispensed, leaving container 100 empty, container 100 may be again filled as described above. Alternatively, container 100 may be collapsed for storage and shipped in its empty, collapsed state to another site for filling. Due to the flexible nature of the fabric included in container 100, container 100 collapses under its own weight when disengaged from support system 400. To assist container 100 as it collapses, a pump (not shown) may be coupled to valve 125 and valve 125 opened. The pump may then be activated to provide a partial vacuum on container 100 and thereby assist the collapse of container 100. Once collapsed, container 100 may be folded to fit into a storage space that is only a fraction the space occupied by container 100 when filled.

While various preferred embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A container for storing and dispensing material comprising:
   - a filling cap comprising a filling port to receive the material and a vent port;
   - a dispensing cone comprising an outlet port to dispense the material;
   - a valve closeable to seal off said dispensing cone outlet port as well as selectably openable to control the rate material is continuously dispensed from the container;
   - a body extending between said filling cap and said dispensing cone, said body comprising a fabric, and said dispensing cone extending, at least partially, out from said body;
   - wherein the filling port, vent port, and valve are closeable to make the container air-tight; and
   - wherein the container is configured to receive and dispense the material in a vertical orientation.

2. The container of claim 1, wherein said dispensing cone comprises fabric.

3. The container of claim 2, wherein said dispensing cone is integral with said body.

4. The container of claim 2, wherein said dispensing cone and said body are coupled by stitching and an adhesive layer.

5. The container of claim 1, wherein said filling cap comprises fabric.

6. The container of claim 5, wherein said filling cap is integral with said body.

7. The container of claim 5, wherein said filling cap and said body are coupled by stitching and an adhesive layer.

8. The container of claim 1, wherein said body is seamless and comprises a braided fabric.

9. The container of claim 1, wherein the fabric of said body is transparent to at least one of an X-ray inspection and an ultrasonic inspection.

10. The container of claim 1, wherein the fabric of said body is flexible, wherein the container is deformable when at least portion of said body is filled with flowable materials and wherein the container is collapsible when said body is empty.

11. The container of claim 1, wherein said fabric is manufactured fiber spun from a liquid crystal polymer.

12. The container of claim 1, wherein said filling cap, said dispensing cone, and said body each further comprise an inner surface coated with a moisture resistant material.

13. The container of claim 1, wherein said filling cap, said dispensing cone, and said body each further comprise an inner surface coated with a pressure containing material.

14. The container of claim 1, wherein said filling cap, said dispensing cone, and said body each further comprise an inner surface coated with polyurethane.

15. The container of claim 1, wherein said filling cap, said dispensing cone, and said body each further comprise an outer surface coated with a material resistant to at least one of a group consisting of ultraviolet radiation, moisture, and ozone.

16. The container of claim 15, wherein the material is polyurethane.

17. A system comprising:

a container comprising:

a filling cap comprising a filling port to receive the material and a vent port;

a dispensing cone comprising an outlet port to dispense the material; and a valve closeable to seal off said dispensing cone outlet port as well as selectably openable to control the rate material is continuously dispensed from the container;

a body extending between said filling cap and said dispensing cone, said body comprising a braided fabric, and said dispensing cone extending, at least partially, out from said body;

wherein the filling port, vent port, and valve are closeable to make the container air-tight; and wherein the container is configured to receive and dispense the material in a vertical orientation; and webbing surrounding said container to support the entire weight of the container in a vertical orientation when filling the container with, storing, and dispensing the material, said webbing comprising:

a plurality of horizontal straps disposed circumferentially about said shipping and dispensing container;

a plurality of vertical straps extending substantially perpendicularly to and overlapping the horizontal straps;

a plurality of attachment locations where one of the horizontal straps overlaps one of the vertical straps; and at least one grappling device coupled to one of the plurality of attachment locations.

18. The system of claim 17, wherein said at least one grappling device is a D-ring.

19. The container of claim 17, wherein said dispensing cone and said filling cap comprise braided fabric.

20. The container of claim 19, wherein said braided fabric of said body, said filling cap, and the dispensing cone are manufactured fiber spun from a liquid crystal polymer.

21. The container of claim 17, wherein said dispensing cone and said filling cap are integral with said body.

22. The container of claim 17, wherein said braided fabric of said body is transparent to X-ray and ultrasonic inspections.

23. The container of claim 17, wherein said filling cap, said dispensing cone, and said body each further comprise an inner surface coated with a moisture resistant material.

24. The container of claim 17, wherein said filling cap, said dispensing cone, and said body each further comprise an inner surface coated with a pressure containing material.

25. The container of claim 17, wherein said filling cap, said dispensing cone, and said body each further comprise an inner surface coated with polyurethane.

26. The container of claim 17, wherein said filling cap, said dispensing cone, and said body each further comprise an outer surface coated with a material resistant to at least one of a group consisting of ultraviolet radiation, moisture, and ozone.

27. The container of claim 26, wherein the material is polyurethane.

28. The container of claim 1, further comprising webbing outside of said body to support the entire weight of the container in a vertical orientation when filling the container with, storing, and dispensing the material.

29. A container for storing and dispensing material comprising:

a filling cap comprising a filling port to receive the material and a vent port;

a dispensing cone comprising an outlet port to dispense the material;

a valve closeable to seal off said dispensing cone outlet port as well as selectably openable to control the rate material is continuously dispensed from the container;

a body extending between said filling cap and said dispensing cone, said body comprising a fabric;

wherein a portion of said dispensing cone coupled to a portion of said body comprises a substantially similar outer diameter as the portion of said body; and wherein the filling port, vent port, and valve are closeable to make the container air-tight; and wherein the container is configured to receive and dispense the material in a vertical orientation.

30. The container of claim 29, wherein said dispensing cone extends, at least partially, out from said body.

31. The container of claim 29, wherein said dispensing cone is integral with said body.

32. The container of claim 29, wherein the fabric of said body is flexible, wherein the container is deformable when at least portion of said body is filled with flowable materials and wherein the container is collapsible when said body is empty.

* * * * *